US005229821A

United States Patent [19]

Fujii

[11] Patent Number: 5,229,821

[45] Date of Patent: Jul. 20, 1993

[54] PROCESS CARTRIDGE WITH TONER DEPLETION DETECTION FEATURE AND IMAGE FORMING APPARATUS USING THE SAME

[75] Inventor: Haruo Fujii, Yokohama, Japan

[73] Assignee: Canon Kabushiki Kaisha, Tokyo, Japan

[21] Appl. No.: 792,928

[22] Filed: Nov. 15, 1991

[30] Foreign Application Priority Data

Nov. 30, 1990 [JP] Japan ..... 2-333811

[51] Int. Cl.[5] ..... G03G 21/00

[52] U.S. Cl. ..... 355/246; 355/200; 355/260; 355/326

[58] Field of Search ..... 355/200, 204, 208, 246, 355/260, 265, 326, 327; 118/691

[56] References Cited

U.S. PATENT DOCUMENTS

| | | | |
|---|---|---|---|
| 4,994,853 | 2/1991 | Fukuchi et al. | 355/208 |
| 4,996,566 | 2/1991 | Morita et al. | 355/246 |
| 4,999,676 | 3/1991 | Mouri | 355/246 |
| 5,030,988 | 7/1991 | Haneda et al. | 355/200 |
| 5,036,367 | 7/1991 | Haneda et al. | 355/260 |

*Primary Examiner*—Michael L. Gellner
*Assistant Examiner*—P. J. Stanzione
*Attorney, Agent, or Firm*—Fitzpatrick, Cella, Harper & Scinto

[57] ABSTRACT

An image forming apparatus is provided with a detachable process cartridge having an electrophotographic photoconductive drum and a plurality of developing units. Each of the developing units has a signal generating device for generating a signal corresponding to the amount of toner in the developing unit, and an output signal of the signal generating device is transmitted to a toner amount discriminating circuit mounted in the body of the image forming apparatus through a common line.

6 Claims, 5 Drawing Sheets

DETECTOR
RECTIFIER
INTEGRATOR
COMPARATOR
DRIVING CIRCUIT
LED
26
22
23
24
25
32
33
34
30
30'
31
31'
21BK
21C
21M
37
10Y
T
40
39
21Y
11
38
D
3
15
14'
14

PROCESS CARTRIDGE WITH TONER DEPLETION DETECTION FEATURE AND IMAGE FORMING APPARATUS USING THE SAME

BACKGROUND OF THE INVENTION

1. Field of the Invention

The present invention relates to a process cartridge having a plurality of developing units using different color toners and being detachable from the body of an image forming apparatus, and an image forming apparatus using such a process cartridge.

2. Description of Related Art

A well-known type of image forming apparatus can output a high-quality image by replacing a process cartridge including an electrophotographic photoconductive member and a developing unit with another cartridge even if toner in the developing unit runs out.

A process cartridge having a plurality of developing units is disclosed in U.S. Pat. No. 4,500,195.

In order to know when it is necessary to replace the process cartridge, it is preferable to provide a means for detecting whether the amount of toner in each developing unit falls below a predetermined amount. Thus, a signal generating member for generating an electric signal in accordance with the amount of remaining toner is also mounted in the developing unit.

However, if a discriminating circuit is mounted in each developing unit so as to discriminate, based on the output of the signal generating member, whether the amount of the toner remaining in the developing unit is above a predetermined amount, the construction of the image forming apparatus becomes complicated and its size is enlarged.

Thus, it is preferable from the point of view of reducing the cost of the process cartridge to mount the above discriminating circuit in the body of the image forming apparatus rather than int he process cartridge.

However, if an output terminal for transmitting a signal from the signal generating member to the discriminating circuit in the apparatus body is disposed in each developing unit in the process cartridge when the process cartridge is attached to the apparatus body, it is necessary to mount a plurality of input terminals to engage the output terminals in the apparatus body. Therefore, the number of the output and input terminals becomes large, thereby increasing the rate of damage and contact failure of these terminals when the process cartridge is attached to the image forming apparatus.

SUMMARY OF THE INVENTION

A first object of the present invention is to provide an image forming apparatus which has a detachable process cartridge containing a plurality of developing units, and which does not have a complicated construction despite having a means for detecting the amount of remaining toner or the presence of toner in the process cartridge.

A second object of the present invention is to provide an improved process cartridge applicable to the above image forming apparatus.

A third object of the present invention is to provide a process cartridge capable of decreasing the rate of damage an contact failure of terminals, each of which transmits a signal corresponding to the amount of remaining toner, and an image forming apparatus to which the process cartridge is attached.

The present invention in one aspect pertains to an image forming apparatus comprising a process cartridge having an electrostatic latent image bearing member and a plurality of developing units for supplying toners of different colors to the electrostatic latent image bearing member, and detachable from the body of the image forming apparatus, each of the developing units including a toner container for containing the toner, a developing agent bearing member for bearing and transporting the toner supplied from the toner container and applying the toner to the electrostatic latent image bearing member, and a signal generating member for generating an electric signal corresponding to the amount of the toner in the toner container, and the process cartridge further including a common terminal to which the electric signal generated by the signal generating member in each of the developing units is transmitted, support means for detachably supporting the process cartridge, a signal receiving terminal which is disposed in the body of the image forming apparatus and engaged with the common terminal when the process cartridge is supported by the support means, and discriminating means for discriminating the amount of the toner container in each of the developing units based on the electric signal transmitted through the signal receiving terminal.

The present invention in yet another aspect pertains to a process cartridge detachable from the body of an image forming apparatus comprising an electrostatic latent image bearing member, a plurality of developing units for supplying toners of different colors to the electrostatic latent image bearing member, each of the developing units including a toner container for containing the toner, a developing agent bearing member for bearing and transporting the toner supplied from the toner container and applying the toner to the electrostatic latent image bearing member, and a signal generating member for generating an electric signal corresponding to the amount of the toner in the toner container, and an output terminal to which the electric signal generated by the signal generating member in each of the developing units is transmitted, the output terminal being engaged with an input terminal disposed in the body of the image forming apparatus having discriminating means for discriminating the amount of the toner in the toner container in the developing unit based on the electric signal, when the process cartridge is attached to support means in the body of the image forming apparatus.

The present invention in still a further aspect pertains to an image forming apparatus comprising support means for detachably supporting a process cartridge, the process cartridge including an electrostatic latent image bearing member, and a plurality of developing units each applying toners of different colors to the electrostatic latent image bearing member, and having a toner container for containing the toner, a developing agent bearing member for bearing and transporting the toner supplied from the toner container and applying the toner to the electrostatic latent image bearing member, and a signal generating member for generating an electric signal corresponding to the amount of the toner in the toner container, an optical system for radiating image information light onto the electrostatic latent image bearing member in the process cartridge which is mounted in the support means, discriminating means for discriminating the amount of the toner in each of the developing units based on the electric signal generated by the signal generating member in the developing unit in the process cartridge mounted in the support means, and a common signal transmission line for transmitting the electric signal generated by the signal generating member to the discriminating means.

Other objects and features of the present invention will be apparent from the following description.

DESCRIPTION OF THE PREFERRED EMBODIMENTS

Figure 1:
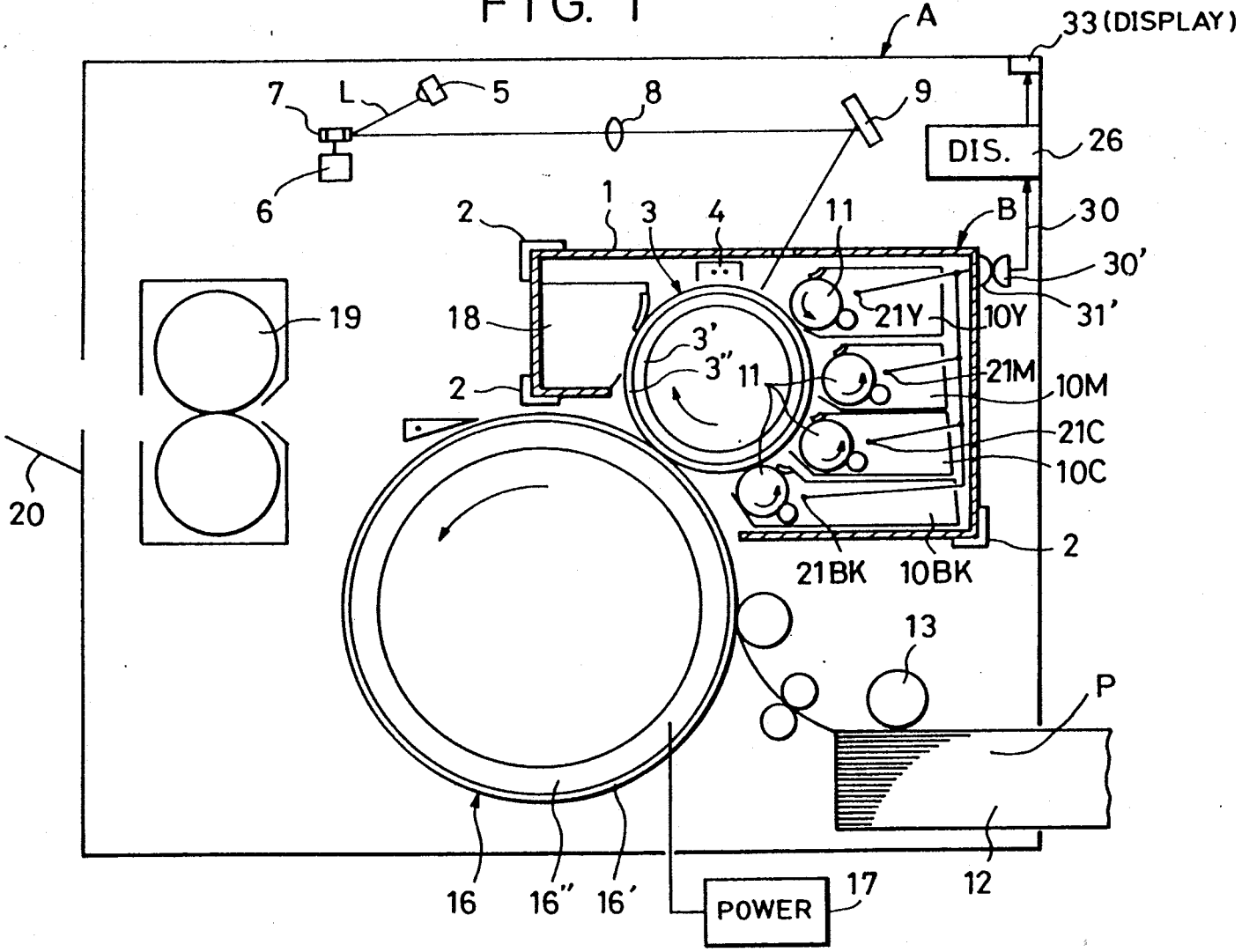
FIG. 1 is an explanatory view of a first embodiment of the present invention.

As shown in FIG. 1, a process cartridge B is detachably mounted in the body A of a color image forming apparatus. In other words, the cartridge B is mounted in and detached from the apparatus body A by being engaged with a support guide 2 and being adapted to move along the guide 2.

The cartridge B contains an electrophotographic photoconductive drum 3 serving as an image bearing member, a corona charger 4, developing units 10Y, 10M, 10C and 10BK, and a cleaning device 18, assembled as a unit in a support frame 1. The photoconductive drum 3 is formed by applying a photoconductor 3'' made of an organic photoconductor (OPC) around an aluminum cylinder 3' having a diameter of 60 mm, and rotated in the direction of the arrow by an unillustrated driving means at a peripheral velocity of 50 mm/sec.

The developing units 10Y, 10M, 10C and 10BK contain a yellow toner, a magenta toner, a cyan toner and a black toner, respectively, each have a developing roller 11.

A laser diode 5, a polygon mirror 7 rotated by a high speed motor 6, a lens 8 and a slanted mirror 9, which constitute an exposure device, are placed above the cartridge B in the apparatus body A, and a transfer roller 16 is disposed in the approximate center of the apparatus body A.

The transfer roller 16 is formed by winding a sheet 16' having a thickness of 2 mm around a metallic cylinder 16'' having a diameter of 116 mm, and rotated in the direction of the arrow by an unillustrated driving means. The sheet 16' is made by dispersing carbon, zinc oxide and so on in resin, and its resistivity is set at $10^7 \sim 10^{13}\Omega$.cm. Numeral 17 denotes a power supply for applying voltage to the transfer roller 16.

Furthermore, a fixing device 19 and a sheet feed roller 13 are mounted in the apparatus body A. A recording sheet cassette 12 is inserted in the apparatus body A, and a sheet eject tray 20 is attached to the apparatus body A opposite to the recording sheet cassette 12. A plurality of recording sheets P are stacked in the recording sheet cassette 12.

In this embodiment, the photoconductive drum 3 and the transfer roller 16 are arranged in parallel in the axial direction (perpendicular to the sheet plane shown in FIG. 1), and in contact with each other under a predetermined amount of pressure.

The operation of the color image forming apparatus of the present invention will now be described.

While the photoconductive drum 3 in the cartridge B is rotated in the direction of the arrow, the surface of the photoconductive drum 3 is uniformly charged at −600 V by the corona charger 4.

When an electric signal for an yellow image is supplied to the laser diode 5, the laser diode 5 radiates image light L corresponding to the signal onto the rotating polygon mirror 7. The image light L is reflected by the polygon mirror 7, passed through the lens 8, reflected again by the slanted mirror 9, and radiated onto the photoconductive drum 3, thereby forming an electrostatic latent image on the photoconductive drum 3. Light energy at this time is selected so that the surface potential of the photoconductive drum 3 is −60 V.

The electrostatic latent image formed on the photoconductive drum 3 is reversely developed by the developing unit 10Y. In other words, an oscillating bias voltage, which is obtained by superimposing an alternating voltage of $1000 \sim 2000\ V_{p\text{-}p}$ (peak to peak) on a direct voltage (of, for example, −500 V) having the same polarity as the charge polarity of the photoconductive drum 3, is applied to the developing roller 11 so that the negatively charged yellow toner adheres to irradiated portions of the photoconductive drum 3. The toner is transferred from the roller 11 and adheres to the latent image.

During the development operation performed by the developing unit 10Y, it is necessary to stop the operation of the other developing units 10M, 10C and 10BK. Therefore, the developing units 10M, 10C and 10BK are separated from the photoconductive drum 3, a direct voltage having a polarity reverse to that of the toner or a negative direct voltage without the above-mentioned alternating component is applied to the rollers 11 in the developing units 10M, 10C and 10BK in order to prevent the toner from being supplied to the photoconductive drum 3, or the developing rollers 11 in the developing units 10M, 10C and 10BK are stopped. The development operations of the developing units 10M, 10C and 10BK may be stopped by the arbitrary combination of the above methods.

On the other hand, the recording sheet P in the recording sheet cassette 12 is fed by the sheet feed roller 13 and wound around the transfer roller 16. Therefore, the circumference of the transfer roller 16 is set longer than the length of the recording sheet P. In order to hold the leading end of the recording sheet P, the transfer roller 16 is provided with a gripper or a vacuum means, or an insulating member, such as a Mylar sheet, is provided on its surface so as to electrostatically attract the sheet 16'.

Thus, a voltage of $+1 \sim 5$ KV having a polarity reverse to that of the toner is applied from the power supply 17 to the transfer roller 16. If the recording sheet P has a width of 210 mm and a basis weight of 80 g/m$^2$, the yellow toner is transferred onto the recording sheet P wound on the transfer roller 16 by selecting a transfer current of $1 \sim 1.5\ \mu$A, thereby forming a yellow visible image.

The residual toner on the photoconductive drum 3 after the transferring of the image is removed by the cleaning device 18 having a cleaning means, such as a blade, a fur brush or a magnetic brush. After being uniformly charged again by the corona charger 4, the photoconductive drum 3 is irradiated by a magenta image light L, and an electrostatic latent image is formed on the surface of the photoconductive drum 3, and developed into a magenta visible image with the magenta toner in the developing unit 10M. The magenta image is transferred onto the yellow image on the recording sheet P which is wound around the transfer roller 16.

Similarly, a cyan toner image and a black toner image are formed in this order on the photoconductive drum 3 by the developing units 10C and 10BK, respectively, and transferred one on top of the other on the recording sheet P. Subsequently, the recording sheet P is separated from the transfer roller 16 and sent to the fixing device 19. In the fixing device 19, the yellow, magenta, cyan and black toner images transferred onto the recording sheet P are fixed by heat and pressure, and the recording sheet P, on which the toner images are fixed, is ejected onto the sheet eject tray 20.

When the toner in one of the developing units 10Y, 10M, 10C and 10BK runs out, if a warning is not provided, the operator is likely to continue the operation without being aware of lack of toner.

According to this embodiment, as shown in FIG. 1, conductors i.e. antennas 21Y, 21M, 21C and 21BK each for detecting the presence of one of the toners are disposed in the developing units 10Y, 10M, 10C and 10BK, respectively. These antennas 21Y, 21M, 21C and 21BK are connected to a discriminating circuit 26 through one signal transmission line 30.

Figure 2:
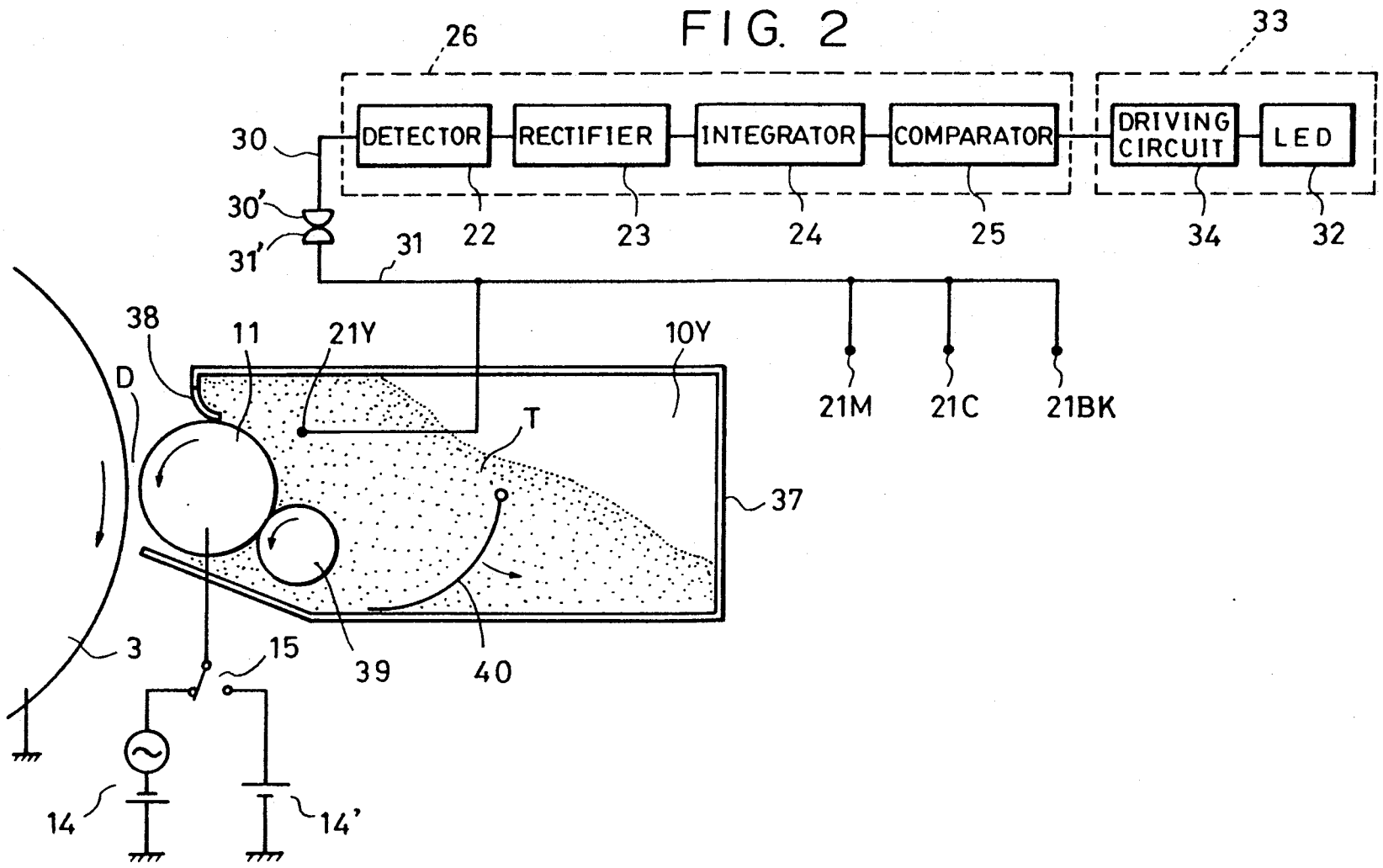
FIG. 2 is an explanatory view of the principal components of the first embodiment.

Since the developing units 10Y, 10M, 10C and 10BK basically have almost the same construction, the developing unit 10Y as being representative of the units will now be described in more detail with reference to FIG. 2.

The developing unit 10Y has a container 37 for containing the toner T, and the developing roller 11 rotatably supported by the container 37. In the container 37, the thickness of the toner supplied onto the developing roller 11 is limited by a developing agent thickness limiting member, such as a rubber blade 38, in elastic contact with the roller 11, and the toner is conveyed into a developing area D in correlation with the rotation of the roller 11, and transferred from the roller 11 to the photoconductive drum 3 in the developing area D.

The thickness of the toner limited by the blade 38 is smaller than the interval between the roller 11 and the photoconductive drum 3. Therefore, what is called "non-contact development" is carried out.

In order to transfer the toner from the roller 11 to the drum 3, the above oscillating bias voltage is applied from a power supply 14 mounted in the apparatus body A to the roller 11 during the developing operation of the developing unit 10Y. On the other hand, during the development operations of the other developing units, a non-developing bias voltage which does not transfer the toner from the roller 11 and cause it to adhere to the photoconductive drum 3 is applied from a power supply 14' in the apparatus body A to the roller 11 in the unit 10Y in correlation with the operation of a switch 15. Although the non-developing bias voltage is a positive direct bias voltage having a polarity reverse to the charge polarity of the toner in FIG. 2, it may be a direct voltage having the same polarity as that of the toner.

As described above, the roller 11 in the operating developing unit is rotated, while the rollers 11 in the other developing units are stopped.

A roller 39 for rotating in contact with the developing roller 11 removes the residual toner from the roller 11 which has passed through the developing area D, and supplies new toner onto the roller 11. Furthermore, the toner T in the container 37 is agitated by an agitation member 40.

In the container 37, the antenna 21Y made of a metallic conductor, such as stainless steel, is mounted almost parallel with and opposite to the roller 11.

Therefore, when the above oscillating bias voltage is applied from the power supply 14 to the roller 11 in the developing unit 10Y, an alternating voltage is induced in the antenna 21Y due to the capacitance between the developing roller 11 and the antenna 21Y.

The voltage induced in the antenna 21Y depends on the capacitance between the developing roller 11 and the antenna 21Y. Since the capacitance differs when the amount of toner in the developing unit 10Y is sufficient and the space between the antenna 21Y and the developing roller 11 is filled with the toner and when the toner runs out and the space is not filled with the toner, the voltages induced in the antenna 21Y in the above cases also differ.

In general, since the dielectric constant of the toner is approximately 2~4, the capacitance between the developing roller 11 and the antenna 21Y when the toner is sufficient is twice to four times as much as that where the toner is insufficient.

The voltage induced in the antenna 21Y is transmitted to the discriminating circuit 26 through a signal transmission line 31 in the cartridge B, an output terminal 31' in the cartridge B, an input terminal 30' in the apparatus body A and the signal transmission line 30 in the apparatus body A.

The discriminating circuit 26 comprises a detector 22, a rectifier 23, an integrator 24 and a comparator 25. An alternating voltage signal is induced in the antenna 21Y in accordance with the amount of the remaining toner in the container 37 by applying the above developing bias voltage to the roller 11. The induced signal is passed through the detector 22 serving as an electric filter for allowing alternating voltage in its frequency band pass therethrough, rectified by the rectifier 23, integrated by the integrator 24, changed into direct voltage, and compared with the reference voltage by the comparator 25, so that it is determined whether or not the toner is present in sufficient quantity. In the comparison by the comparator 25, the output voltage of the antenna 21Y when the amount of toner in the container 37 is below a predetermined amount is preset as a reference voltage, and an actual output voltage is compared with the reference voltage.

The output of the antenna 21Y is not detected in the case when the above voltage having the alternating component as the developing bias voltage is not applied to the developing roller 11. In other words, the voltage induced in the antenna 21Y when the above non-developing direct bias voltage is applied to the developing roller 11 is prohibited from passing the alternating voltage detector 22.

The other developing units 10M, 10C and 10BK also have the antennas 21M, 21C and 21BK, respectively. The antennas 21M, 21C and 21BK each are connected to the common line 31 which is connected to the output terminal 31' attached to the frame 1 of the cartridge B. Therefore, an output signal of each antenna is output outside the cartridge B through the output terminal 31'.

The input terminal 30' is located in a predetermined position in the apparatus body A. When the cartridge B is mounted in a predetermined position for an image forming operation in the apparatus body A, the output terminal 31' of the cartridge B engages the input terminal 30' and the output of each antenna can be transmitted to the discriminating circuit 26 through the common line 30 linking the input terminal 30' and the discriminating circuit 26.

When the discriminating circuit 26 discriminates that the amount of toner in one of the developing units falls below a predetermined amount, a display device 33 for warning of the depletion of the toner is activated in response to the output of the discriminating circuit 26. The display device 33 has a LED 32 as a display, lights the LED 32 by a driving circuit 34 activated in response to the output of the discriminating circuit 26, and warns the operator to replace the cartridge B.

The output of the discriminating circuit 26 also may be transmitted to a control circuit for an image forming operation of the image forming apparatus so as to stop the image forming operation when the amount of remaining toner falls below the predetermined amount.

Furthermore, if the discriminating circuit 26 is connected to a host, such as a computer, it is possible to indicate on a screen of the host what color toner is depleted.

Figure 3:
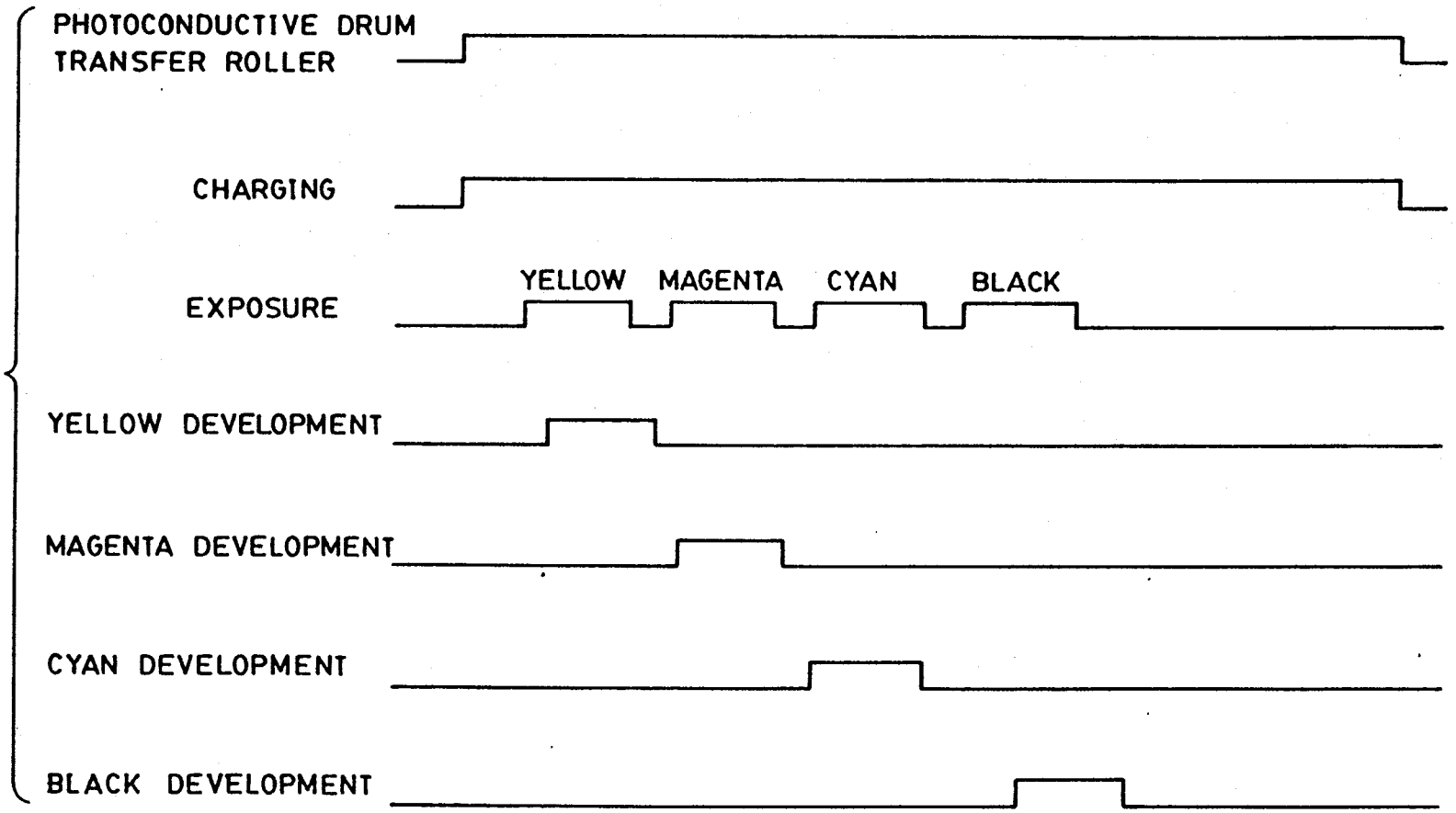
FIG. 3 are time line representations of the operational sequence of the first embodiment.

FIG. 3 shows the operational sequence of the image forming apparatus shown in FIG. 1. The charger 4 is actuated simultaneously with the start of rotation of the photoconductive drum 3 and the transfer drum 16. Then, the laser diode 5 starts to operate in response to an input signal corresponding to a yellow image, and the exposure device forms an electrostatic latent image for the yellow image on the photoconductive drum 3. In the developing unit 10Y, the developing bias voltage in which the alternating component is superimposed on the direct component is supplied to the developing roller 11 simultaneously with the start of rotation of the developing roller 11 a little before the leading end of the electrostatic latent image formed on the photoconductive drum 3 passes the developing unit 10Y, and an induced alternating voltage is generated in accordance with the alternating component voltage applied to the developing roller 11 by the antenna 21Y in the yellow developing unit 10Y and the amount of remaining toner.

On the other hand, since the developing roller 11 of each of the other developing units 10M, 10C and 10BK is not supplied with the developing bias voltage, but with a voltage containing only a direct component, no induced alternating voltage arises in the antenna 21M, 21C and 21BK. Therefore, even if the antennas in the developing units 10Y, 10M, 10C and 10BK are connected to the single discriminating circuit 26, only the output of the antenna 21Y in the developing unit 10Y is compared with the reference signal by the discriminating circuit 26.

By forming magenta, cyan and black images and performing the detection in the same manner as the case of the yellow toner, it is possible to detect the presence of the toners in each of the other developing units 10M, 10C and 10BK.

As described above, if the toner amount detecting means for inducing a signal voltage corresponding to the amount of remaining toner in the conductor by using the developing bias voltage containing an alternating component is used, signals corresponding to the amounts of toners in the developing units are sequentially input to the discriminating circuit 26 of the toner amount detecting means by only applying developing bias voltages to the developing units in order without mounting a select switch or the like in the toner amount detecting means. This simplifies the construction of the apparatus.

Figure 4:
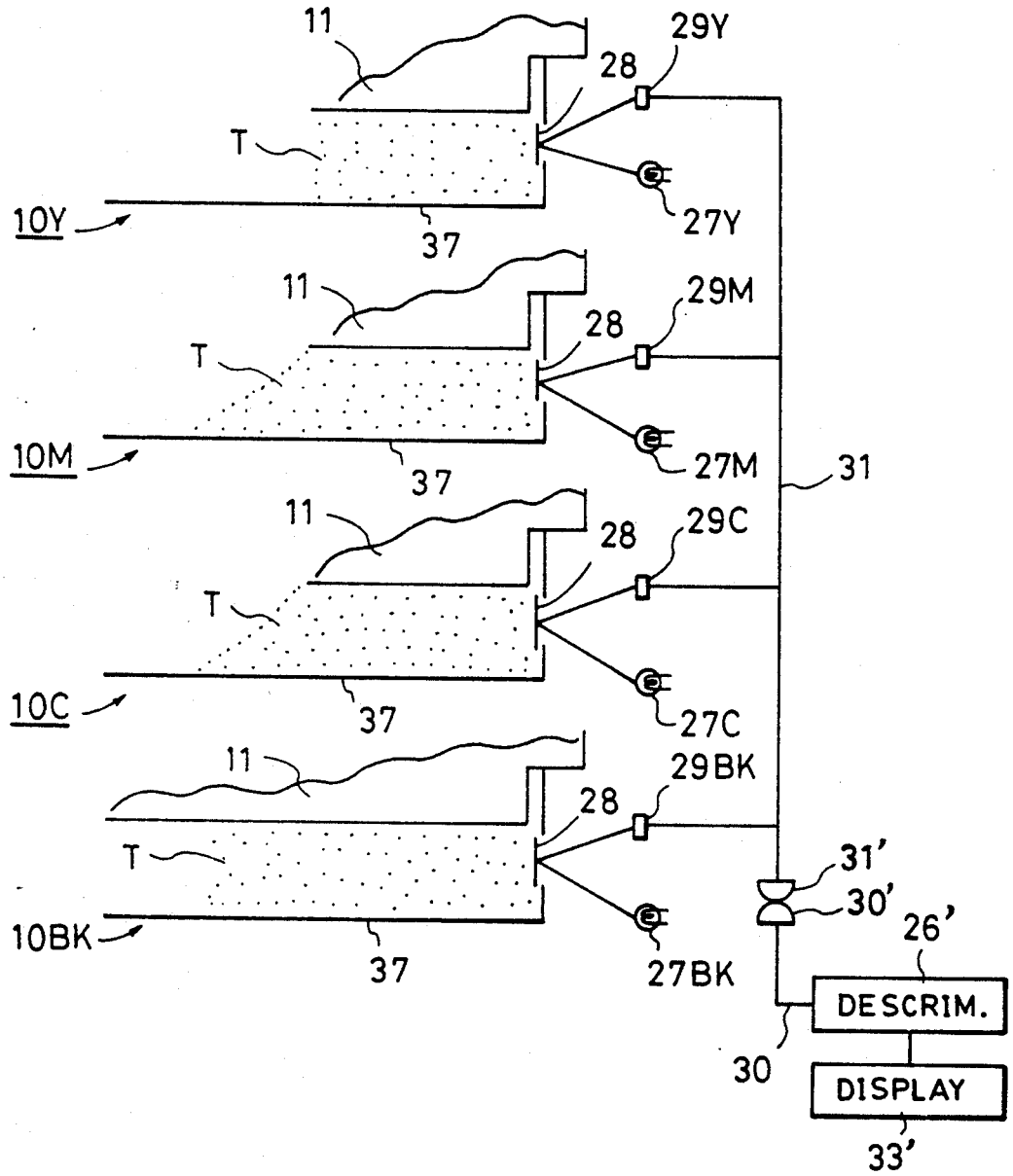
FIG. 4 is an explanatory view of a second embodiment of the present invention.

FIG. 4 shows a second embodiment of the present invention. In this embodiment, a toner amount detecting means is composed of a well-known optical device, that is, light emitting elements 27Y, 27M, 27C and 27BK and light receiving elements 29Y, 29M, 29C and 29BK. More specifically, the light receiving elements 29Y to 29BK each made of a selenium, cadmium sulfide or silicon compound are located near the developing units 10Y, 10M, 10C and 10BK, respectively. The toner container 37 in each of the developing units 10Y, 10M, 10C and 10BK is formed with a window 28 made of transparent glass or resin so as to pass light from each light emitting element 27Y to 27BK, such as a LED, or an incandescent lamp, therethrough. The lights from the light emitting elements 27Y to 27BK are reflected by the toners T in contact with the windows 28 and transmitted to the light receiving elements 29Y to 29BK.

The light receiving elements 29Y to 29BK each are connected to the common line 31 and input to a discriminating circuit 26' through the terminals 30' and 31' and the line 30 in the same manner as above. The discriminating circuit 26' has a comparison circuit for comparing a signal voltage transmitted through the line 30 with the reference voltage, and controls the warning display device 33.

The light emitting elements 27Y to 27BK are not lighted simultaneously, but rather one by one.

In the same manner as in the first embodiment, when the amount of toner in one of the developing units 10Y, 10M, 10C and 10BK falls below a predetermined amount, since the light emitted from the light emitting element is not reflected by the window 28 of the developing unit and not radiated to the light receiving element, the resistance value of the output of the light receiving element or the value of the photoelectromotive force changes and the same detection as that in the first embodiment is possible.

In order to detect which of the developing units 10Y, 10M, 10C and 10BK runs out of toner, it is necessary to light only the light emitting element opposite to the selected developing unit. Since the toner amount detecting means is likely to make incorrect operations when the window 28 is soiled by toner and so on, a well-known method of always scraping the toner from the window 28 by a wiper (not shown) attached to the agitation means in the developing unit may be used.

Figure 5:
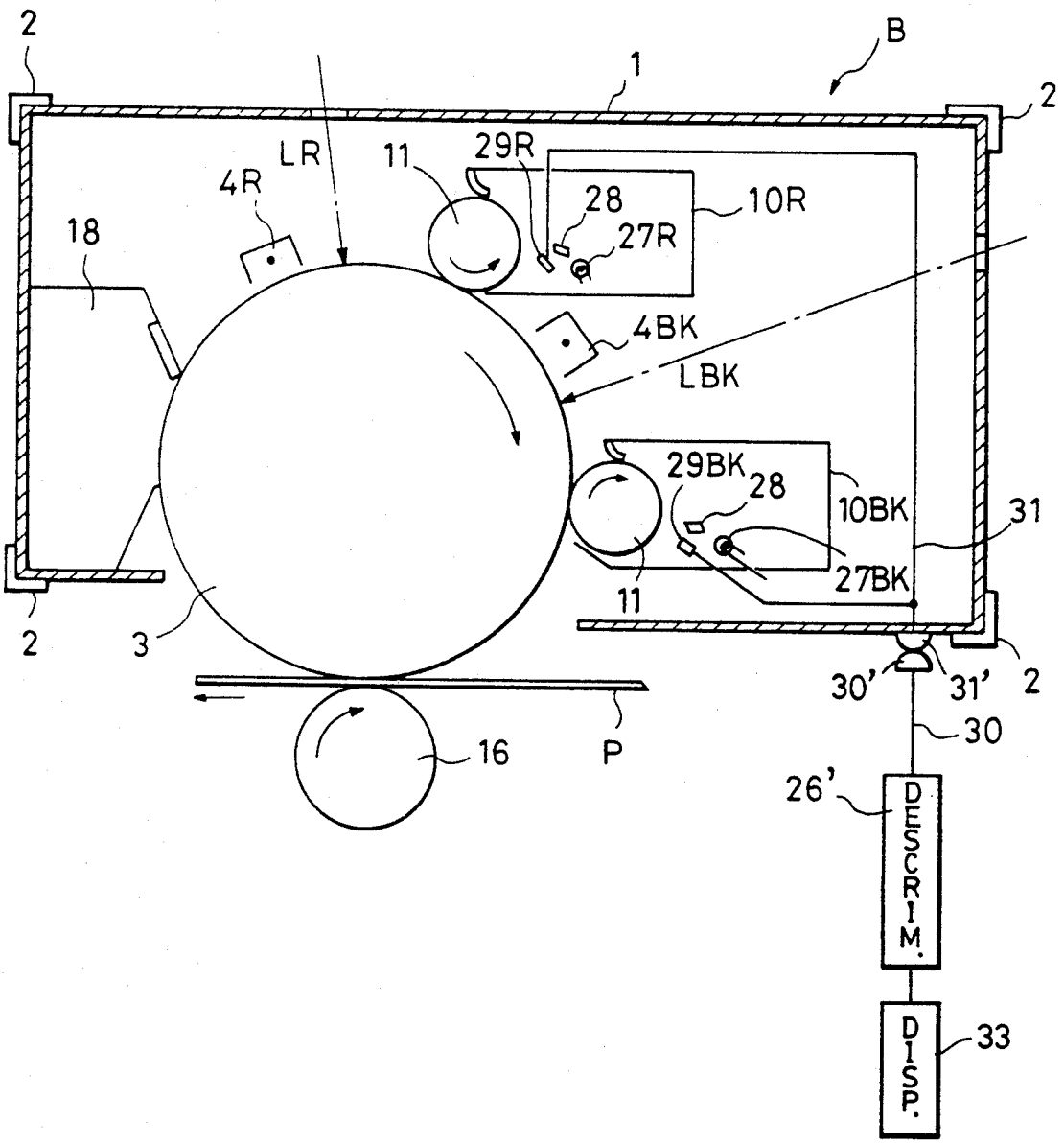
FIG. 5 is an explanatory view of a third embodiment of the present invention.

FIG. 5 shows a third embodiment of the present invention. A first charger 4R and a second charger 4BK are disposed at a predetermined interval opposite to the photoconductive drum 3, and image information lights LR and LBK enter from two points corresponding to the two chargers.

In other words, the photoconductive drum 3 is uniformly charged by the first charger 4R, the light LR corresponding to a red image is radiated onto the photoconductive drum 3 so as to form an electrostatic latent image, and red toner is stuck to the latent image by a red development unit 10R so as to visualize the latent image. Then, the photoconductive drum 3 on which the red toner image is formed is charged again by the second charger 4BK, the light LBK corresponding to a black image is radiated onto the photoconductive drum 3 so as to form an electrostatic latent image, and black toner is stuck to the latent image by a black developing unit 10BK. After that, the obtained red and black toner images are transferred onto the recording sheet P.

The same toner amount detecting means as that shown in FIG. 4 is used in this embodiment. If either the developing unit 10R or 10BK detects the presence of the toner, the light emitting element 27R or 27BK is selected.

As described above, although the present invention can be carried out by an optical device which applies the induction of voltage by the antenna or the like, and the light reflection and transmission, it may be also carried out by a piezoelectric element, a magnetic induction element or the like. Furthermore, although the presence of the toner is detected in the above-given description, the density of the toner can be detected in a two-component developing apparatus and so on.

While the present invention has been described with respect to what presently are considered to be the preferred embodiments, it is to be understood that the invention is not limited to the disclosed embodiments. To the contrary, the present invention is intended to cover various modifications and equivalent arrangements included with the spirit and scope of the claims. The following claims are to be accorded a broad interpretation, so as to encompass all such modifications and equivalent structures and functions.

What is claimed is:

1. An image forming apparatus, comprising:

a process cartridge having an electrostatic latent image bearing member and a plurality of developing units for supplying toners of different colors to said electrostatic latent image bearing member, and detachable from the body of said image forming apparatus, each of said developing units including a toner container for containing the toner, a developing agent bearing member for bearing and transporting the toner supplied from said toner container and applying the toner to said electrostatic latent image bearing member, and a signal generating member for generating an electric signal corresponding to the amount of the toner in said toner container, and said process cartridge further including a single common terminal to which the electric signal generated by said signal generating member in each of said developing units is transmitted;

support means for detachably supporting said process cartridge;

a signal receiving terminal which is disposed in the body of said image forming apparatus and engaged with said common terminal when said process cartridge is supported by said support means; and discriminating means for discriminating the amount of the toner in said toner container in each of said developing units based on the electric signal transmitted through said signal receiving terminal.

2. An image forming apparatus according to claim 1, further comprising means for applying a developing bias voltage containing an alternating component to said developing agent bearing member in a selected one of said developing units.

3. An image forming apparatus according to claim 2, wherein said signal generating member in each of said developing units is a conductor located opposite to said developing agent bearing member and generates an induced voltage corresponding to the amount of the toner by applying the developing bias voltage to said developing agent bearing member.

4. An image forming apparatus according to claim 1, wherein said signal generating members in said developing units generate signals in turn.

5. A process cartridge detachable from the body of an image forming apparatus, comprising:

an electrostatic latent image bearing member;

a plurality of developing units for supplying toners of different colors to said electrostatic latent image bearing member, each of said developing units including a toner container for containing the toner, a developing agent bearing member for bearing and transporting the toner supplied from said toner container and applying the toner to said electrostatic latent image bearing member, and a signal generating member for generating an electric signal corresponding to the amount of the toner in said toner container; and A single common output terminal to which the electric signal generated by said signal generating member in each of said developing units is transmitted, said output terminal being engaged with an input terminal disposed in the body of said image forming apparatus having discriminating means for discriminating the amount of the toner in said toner container in said developing unit based on the electric signal, when said process cartridge is attached to support means in the body of said image forming apparatus.

6. A process cartridge according to claim 5, wherein said signal generating member is a conductor disposed opposite to said developing agent bearing member for generating an induced voltage corresponding to the amount of the toner by applying the developing bias voltage to said developing agent bearing member.

* * * * *

UNITED STATES PATENT AND TRADEMARK OFFICE

CERTIFICATE OF CORRECTION

PATENT NO. : 5,229,821

DATED : July 20, 1993

INVENTOR(S) : Haruo Fujii

It is certified that error appears in the above-indentified patent and that said Letters Patent is hereby corrected as shown below:

COLUMN 1

Line 38, "int he" should read --in the--.

COLUMN 10

Line 34, "A" should read --a--.

Signed and Sealed this

Fifteenth Day of March, 1994

*Attest:*

*Attesting Officer*

Bruce Lehman

BRUCE LEHMAN

*Commissioner of Patents and Trademarks*